US005824458A

United States Patent [19]

Okutsu et al.

[11] Patent Number: 5,824,458

[45] Date of Patent: Oct. 20, 1998

[54] DEVELOPER AND FIXING SOLUTION FOR SILVER HALIDE PHOTOGRAPHIC MATERIAL AND PROCESSING METHOD USING THE SAME

[75] Inventors: Eiichi Okutsu; Rikio Inoue, both of Kanagawa, Japan

[73] Assignee: Fuji Photo Film Co., Ltd., Kanagawa, Japan

[21] Appl. No.: 858,881

[22] Filed: May 19, 1997

Related U.S. Application Data

[63] Continuation of Ser. No. 650,551, May 20, 1996, abandoned, which is a continuation of Ser. No. 394,744, Feb. 27, 1995.

[30] Foreign Application Priority Data

| | | | |
|---|---|---|---|
| Feb. 28, 1994 | [JP] | Japan | 6-030203 |
| Mar. 22, 1994 | [JP] | Japan | 6-050388 |

[51] Int. Cl.[6] ..... G03C 5/305

[52] U.S. Cl. ..... 430/490; 430/480; 430/483; 430/488

[58] Field of Search ..... 430/464, 465, 430/475, 480, 483, 486, 488, 490

[56] References Cited

U.S. PATENT DOCUMENTS

| | | | |
|---|---|---|---|
| 2,688,548 | 9/1954 | Reynolds | 430/488 |
| 4,298,681 | 11/1981 | Bullock et al. | 430/466 |
| 4,816,384 | 3/1989 | Fruge et al. | 430/465 |
| 5,098,819 | 3/1992 | Knapp | 430/446 |
| 5,196,298 | 3/1993 | Meeus et al. | 430/440 |
| 5,264,323 | 11/1993 | Purol et al. | 430/441 |
| 5,278,036 | 1/1994 | Kobayashi et al. | 430/465 |
| 5,364,746 | 11/1994 | Inoue et al. | 430/488 |
| 5,376,510 | 12/1994 | Parker et al. | 430/440 |
| 5,648,205 | 7/1997 | Okutsu | 430/483 |

FOREIGN PATENT DOCUMENTS

| | | | |
|---|---|---|---|
| 566323 | 10/1993 | European Pat. Off. | 430/488 |
| 593262 | 4/1994 | European Pat. Off. . | |
| 3055541 | 3/1991 | Japan | 430/488 |
| 3132649 | 6/1991 | Japan | 430/488 |

*Primary Examiner*—Hoa Van Le
*Attorney, Agent, or Firm*—Sughrue, Mion, Zinn, Macpeak & Seas, PLLC

[57] ABSTRACT

A one-part liquid developer for a black and white silver halide photographic material, comprising:

i) an ascorbic acid or derivative thereof as a developing agent, ii) an auxiliary developing agent having super-additivity, iii) an alkali agent necessary for giving a pH of about 9, and iv) a compound for enhancing development.

2 Claims, No Drawings

DEVELOPER AND FIXING SOLUTION FOR SILVER HALIDE PHOTOGRAPHIC MATERIAL AND PROCESSING METHOD USING THE SAME

This is a Continuation of application Ser. No. 08/650,551 filed May 20, 1996, now abandoned, which is a continuation of application Ser. No. 08/394,744 filed Feb. 27, 1995.

FIELD OF THE INVENTION

The present invention relates to a developer for a silver halide photographic material and a processing method using the same, particularly, it relates to a developer comprising a developing agent other than hydroquinone for processing a black-and-white silver halide photographic material and a processing method using the same.

BACKGROUND OF THE INVENTION

A black-and-white silver halide photographic material for general use (e.g., for X-ray, for plate making, for microphotograph, for negative film) is conventionally processed with an alkaline developer comprising hydroquinone as a developing agent and a 3-pyrazolidone-based compound or an aminophenolic compound as an auxiliary developing agent and then it is subjected to fixing and water-washing to form an image thereon. In particular, the X-ray photographic material contains relatively a large amount of silver halide and is rapidly processed and accordingly, a highly active developer containing a large amount of hydroquinone as a developing agent is used therefor. In order to maintain the high activity, such a developer is replenished in a large amount to cope with the air oxidation. However, the hydroquinone is raising an issue of safety due to its own toxicity. As a substitute for hydroquinone used as a developing agent, U.S. Pat. No. 2,688,549 and JP-A-3-249756 (the term "JP-A" as used herein means an "unexamined published Japanese patent application") propose reductones, however, hitherto not known is a processing method using such a developing agent in a one-part liquid simplified developer, which causes little silver stain and requires small replenishing amount per unit area of the photographic material.

The silver stain inhibitor for use in the developer is described in JP-B-56-46585 (the term "JP-B" as used herein means an "examined Japanese patent publication"), JP-B-62-4702, JP-B-62-4703, U.S. Pat. Nos. 4,254,215 and 3,318,701, JP-B-58-203439, JP-B-62-56959, JP-B-62-28459, JP-B-62-178247, JP-A-1-200249, Japanese Patent Application Nos. 3-94955, 3-112275 and 3-233718 and EP-566323A2, however, the use thereof in a one-part liquid and simplified developer comprising an ascorbic acid or its derivative as a developing agent is not known.

SUMMARY OF THE INVENTION

An object of the present invention is to provide a simplified and one-part liquid developer for a silver halide photographic material (in particular, a black-and-white photographic material) using as a developing agent an ascorbic acid and/or its derivative in place of hydroquinone and containing a, silver stain inhibitor.

Another object of the present invention is to provide a method for processing a silver halide photographic material with the above-described simplified and one-part liquid developer using as a developing agent an ascorbic acid and/or its derivative in place of hydroquinone and containing a silver stain inhibitor.

The waste water from developer has a high chemical oxygen demand (so-called COD) and a high biological oxygen demand (so-called BOD) and accordingly, it has been demanded to reduce the replenishing amount of the developer per unit area of the silver halide photographic material (in particular, a black-and-white photographic material) so as to lighten the economic load in waste water treatment.

These and other objects of the present invention will become more apparent from the following detailed description and examples.

The above-described objects of the present invention have been achieved by a one-part liquid developer for a silver halide photographic material (in particular, a black-and-white photographic material) comprising the composition described below, preferably in the state that the one-part liquid developer is housed in a packing material having an oxygen permeability of 50 ml/m$^2$.atm.day or less.

The above-described objects of the present invention have also been achieved by a method for processing a silver halide photographic material (in particular, a black-and-white photographic material) with the above-described one-part liquid developer at a replenishing rate of 300 ml or less per m$^2$ of the black-and-white silver halide photographic material.

Composition of One-part Liquid Developer (a) an ascorbic acid or a derivative thereof as a developing agent;

(b) an auxiliary developing agent having super-additivity;

(c) an alkali agent necessary at least for giving a pH of 9.0; and (d) a compound represented by formula (I) or (II):

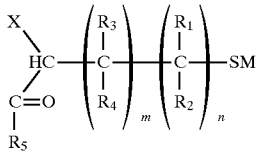

(I)

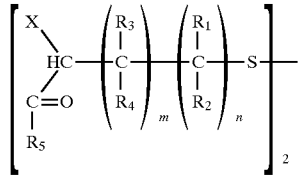

(II)

wherein $R_1$ and $R_2$ each represents a hydrogen atom, an alkyl group having from 1 to 3 carbon atoms or a phenyl group, $R_3$ and $R_4$ each represents a hydrogen atom or an alkyl group having from 1 to 3 carbon atoms, m and n each represents 0, 1 or 2, $R_5$ represents a hydroxyl group, an amino group or an alkyl group having from 1 to 3 carbon atoms, M represents a hydrogen atom, an alkali metal atom or an ammonium group, X represents a hydrogen atom, an alkyl group having from 1 to 3 carbon atoms, a sulfonyl group, an amino group, an acylamino group, a dimethylamino group, an alkylsulfonylamino group or an arylsulfonylamino group.

Specific examples of particularly preferred ascorbic acid or derivatives thereof for use in the present invention are described below, but the present invention should not be construed as being limited thereto.

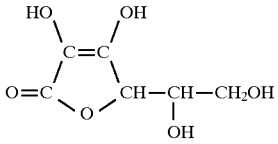
5-1

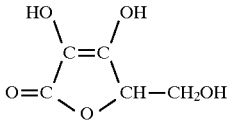
5-2

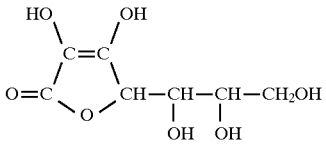
5-3

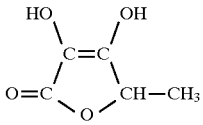
5-4

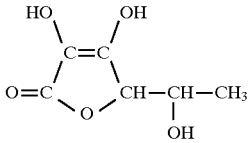
5-5

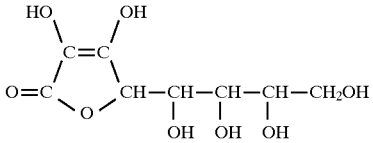
6-1

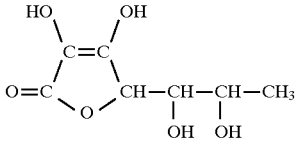
6-2

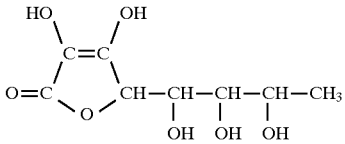
6-3

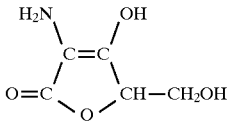
6-4

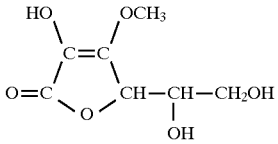
6-5

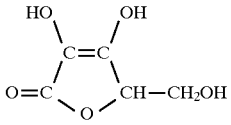
6-6

-continued

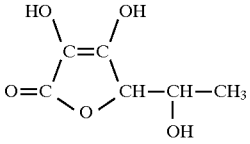
6-7

The ascorbic acid used in the present invention can be used in the form of an alkali metal salt such as a lithium salt, a sodium salt or a potassium salt. The ascorbic acid is used in an amount of preferably from 1 to 100 g, more preferably from 5 to 80 g, per l of the developer.

Examples of a 3-pyrazoline developing agent which can be used as an auxiliary developing agent having super-additivity include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tollyl-4,4-dimethyl-3-pyrazolidone, and 1-p-tollyl-4-methyl-4-hydroxymethyl-3-pyrazolidone.

Among these compounds, 1-phenyl-4-methyl-4-hydroxymethyl-3-pyrazolidone is preferred.

These auxiliary developing agent are used in an amount of preferably from $1\times10^{-4}$ to $1\times10^{-1}$ mol per liter of the developer, more preferably from $5\times10^{-4}$ to $5\times10^{-2}$ mol per liter of the developer and most preferably from $1\times10^{-3}$ to $3\times10^{-2}$ mol per liter of the developer.

Examples of the p-aminophenol developing agent which can be used as an auxiliary developing agent in the present invention include N-methyl-p-aminophenol, N-(β-hydroxyethyl)-p-aminophenol, N-(4-hydroxyphenyl) glycine, 2-methyl-p-aminophenol, and p-benzylaminophenol. Particularly preferred among these compounds is N-methyl-p-aminophenol.

The auxiliary developing agent are used in an amount of preferably from $1\times10^{-4}$ to $1\times10^{-1}$ mol per liter of the developer and more preferably from $5\times10^{-4}$ to $5\times10^{-2}$ mol per liter of the developer.

As the alkaline agent necessary at least for giving a pH of 9.0, a pH adjustor such as sodium hydroxide, potassium hydroxide, sodium carbonate, potassium carbonate, tribasic sodium phosphate and tribasic potassium phosphate can be used.

In addition, a pH buffer as disclosed in JP-A-60-93433 may be used.

Specific examples of the compound represented by formula (I) or (II) which can be used in the present invention are described below, but the present invention should not be construed as being limited thereto.

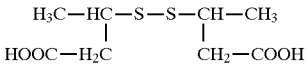
7-1

7-2

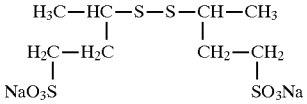
7-3

α-mercaptoisobutyric acid 7-4

$HOOC(CH_2)_2-S-S-(CH_2)_2COOH$ 7-5

$HOOC(CH_2)_3-S-S-(CH_2)_3COOH$ 7-6

-continued 7-7 $H_3C-HC(HOOC)-S-S-CH(COOH)-CH_3$ thiolactic acid 7-8

7-9 $HOOC-C(CH_3)_2-S-S-C(CH_3)_2-COOH$ 8-1 $HOOC-CH_2-C(CH_3)_2-S-S-C(CH_3)_2-CH_2-COOH$ 8-2 $HOOC-CH(HOOC-CH_2)-CH_2-S-S-CH_2-CH(CH_2-CH_3)-COOH$ 8-3 $HOOC-CH(CH_3)-CH(CH_3)-S-S-CH(CH_3)-CH(CH_3)-COOH$ 8-4 $HOOC-C(CH_3)_2-CH_2-S-S-CH_2-C(CH_3)_2-COOH$ 8-5 $HOOC-CH_2-CH(C_6H_5)-S-S-CH(C_6H_5)-CH_2-COOH$ 8-6 $HOOC-CH_2-CH(H_3CH_2C)-S-S-CH(CH_2CH_3)-CH_2-COOH$ 8-7 $NaOOC-CH_2-CH(HOOC-CH_2)-S-S-CH(CH_2COOH)-CH_2-COOH$ 9-1 $C_6H_5-CH(SH)-CH_2-COOH$ 9-2 $CH_3-CH(SH)CH_2-COOH$ 9-3 $CH_3-CO-NH-C(HOOC)(H)-C(CH_3)_2-SH$ 9-4 $CH_3.CO-NH-C(HOOC)(H)-C(C_2H_5)(CH_3)-SH$ 9-5 $CH_3-CO-NH-C(CO-NH_2)(H)-CH_2-C(CH_3)_2-SH$

Among these, Compounds 8-5 and 9-3 are particularly preferred.

The concentration of the compounds represented by formulae (I) and (II) of the present invention in the developer (usable form) is preferably in the range of 0.01 to 50 mmol/l of the developer, more preferably 0.05 to 10 mmol/l of the developer, most preferably 0.1 to 5 mmol/l of the developer.

The developer to be used in the present invention may contain an amino compound to accelerate development. In particular, amino compounds as disclosed in JP-A-50-106244, JP-A-61-267759, and JP-A-2-208652 may be used.

In the present invention, development inhibitors such as potassium bromide and potassium iodide; organic solvents such as dimethylformamide, methyl cellosolve, hexylene glycol, ethanol and methanol; and benztriazole derivatives such as 5-methylbenztriazole, 5-bromobenztriazole, 5-chlorobenztriazole, 5-butylbenztriazole and benztriazole may be used. Particularly preferred among these benztriazole derivatives is 5-methylbenztriazole.

Examples of sulfites which can be incorporated as preservatives in the developer of the present invention include sodium sulfite, potassium sulfite, lithium sulfite, ammonium sulfite, sodium bisulfite, and potassium metabisulfite. Such a sulfite can be preferably used in an amount of 0.01 mol/l of the developer or more, particularly 0.02 mol/l of the developer or more. The upper limit of the amount of such the sulfite to be used is preferably 2.5 mol/l of the developer.

In addition, additives as disclosed in L. F. A. Mason, "Photographic Processing Chemistry", Focal Press, 1966, pp. 226–229, U.S. Pat. Nos. 2,193,015, and 2,592,364, and JP-A-48-64933 may be used.

If desired, the developer may contain a color toning agent, a surfactant, a hard-water softening agent and a hardener.

As the surfactant which may be used in the present invention, a phosphoric acid ester type surfactant may be used.

For example, the compound represented by formula (III) is preferably used.

$$(R_6-Q_1)(R_7-Q_2)P(=O)(Q_3-L-Z) \quad \text{(III)}$$

wherein $R_6$ represents an aliphatic group, an alicyclic group, an aromatic group or heterocyclic ring; $R_7$ represents an aliphatic group, an alicyclic group, an aromatic group, a heterocyclic ring or a —L—Z group; $Q_1$ $Q_2$ and $Q_3$ each represents a single bond, an oxygen atom, a sulfur atom, a —N($R_8$)— group or a —N($R_8$)—CO— group (wherein $R_8$ represents a hydrogen atom or the above group described for $R_7$); L represents a divalent linking group; and Z represents a group having an ionic property.

Examples of chelating agent to be incorporated in the developer include ethylenediamine diorthohydroxyphenylacetic acid, diaminopropanetetraacetic acid, nitrilotriacetic acid, hydroxyethylethylenediaminetriacetic acid, dihydroxyethylglycine, ethylenediaminediacetic acid, ethylenediaminedipropionic acid, iminodiacetic acid, diethylenetriaminepentaacetic acid, hydroxyethyliminodiacetic acid, 1,3-diaminopropanoltetraacetic acid, triethylenetetraminehexaacetic acid, transcyclohexanediaminetetraacetic acid, ethylenediaminetetraacetic acid, glycoletherdiaminetetraacetic acid, ethylenediaminetetrakismethylenephosphonic acid, diethylenetriaminepentamethylenephosphonic acid, nitrilotrimethylenephosphonic acid, 1-hydroxyethylidene-1,1-diphosphonic acid, 1,1-diphosphonoethane-2-carboxylic acid, 2-phosphonobutane-1,2,4-tricarboxylic acid, 1-hydroxy-1-phosphonopropane-1,3,3-tricarboxylic acid, catechol-3,4-disulfonic acid, sodium pyrophosphate, sodium tetrapolyphosphate, and sodium hexametaphosphate. Particularly preferred among these chelating agents are diethylenetriaminepentaacetic acid, triethylenetetraminehexaacetic acid, 1,3-diaminopropanoltetraacetic acid, glycoletherdiaminetetraacetic acid, hydroxyethylethylenediaminetriacetic acid, 2-phosphonobutane-1,2,4-tricarboxylic acid, 1,1-diphosphonoethane-2-carboxylic acid, nitrilotrimethylenephosphonic acid, ethylenediaminetetraphosphonic acid, diethylenetriaminepentaphosphonic acid, 1-hydroxypropylidene-1,1-diphosphonic acid, 1-aminoethylidene-1,1-diphosphonic acid, 1-hydroxyethylidene-1,1-diphosphonic acid, and salts thereof.

As the packing material having an oxygen permeability of 50 ml/m$^2$.atm.day or less at a temperature of 20° C. and a relative humidity of 65%, which is preferably used in the present invention, a packing material having a thickness of 1 mm or more may be used but a flexible container easy for handling is preferred, which is made of a plastic packing material having a thickness of 0.5 mm or less, comprising at least one of a saponified product of an ethylene-vinyl acetate copolymer and nylon and having an oxygen permeability of 50 ml/m$^2$.atm.day or less at a temperature of 20° C. and a relative humidity of 65%.

More preferably, the developer is stored in a container made of a plastic material having an oxygen permeability of 25 ml/m$^2$.atm.day or less (at 20° C., 65% RH), whereby a stable photographic performance can be achieved even after a long-term storage.

The oxygen permeability is determined according to the method described in N. J. Calvano et al., *$O_2$ Permeation of Plastic Container, Modern Packing*, pp. 143–145 (December, 1968).

The plastic packing material comprising at least one of a saponified product of an ethylene-vinyl acetate copolymer ("Eval", a trade name) and nylon and having an oxygen permeability of 50 ml/m$^2$.atm.day or less (at 20° C., 65% RH) may be composed solely of the above-described plastic, may be composed of a combination of the above-described plastic and, for example, polyvinylidene chloride, polyvinyl alcohol ("Vinylon", a trade name), polyvinyl chloride, aluminum foil-laminated film or a film deposited by a metal such as aluminum, or may be a composite film prepared by attaching one of these to a substrate such as polyethylene or an ethylene-vinyl acetate copolymer. The container made of such a plastic packing material may have a form of bottle, cubic type or laminated pillow type. The bottle or cubic type container may be formed from the above-described material having a low oxygen permeability as a laminate by co-extrusion.

The nylon and the saponified product of an ethylene-vinyl acetate copolymer are particularly preferred in view of small oxygen permeability, high strength of the container formed, and easy processability in shaping the material into a container.

The processing solution used in the present invention may be prepared according to the methods described in JP-A-61-177132, JP-A-3-134666 and JP-A-3-67258. The replenishing method of the developer involved in the processing method of the present invention may follow the method described in JP-A-5-216180.

The method for processing a black-and-white silver halide photographic material while replenishing the developer and fixing solution of the present invention in an automatic processor according to the present invention preferably has the following features so as to reduce the necessary amount of processing solutions as well as the amount of waste water therefrom, to diminish odor of the processing solution and to prevent contamination of the fixing tank in the automatic processor.

A. In the method for processing a black-and-white silver halide photographic material while replenishing the developer and fixing solution in an automatic processor according to the present invention, the replenishing amount of the fixing solution is 15 ml or less per 775 cm$^2$ of the photographic material and 0.3 mol or more of thiosulfate ion is present in the fixing solution.

B. In the method for processing a black-and-white silver halide photographic material as described above, 0.2 mol or more of carbonate ion is present per Q of the developer.

C. In the method for processing a black-and-white silver halide photographic material as described above, the silver halide photographic material is fixed with a fixing solution having a pH of from 5.0 to 6.5.

In the method for processing a black-and-white silver halide photographic material with a developer containing an ascorbic acid and/or a derivative thereof according to the present invention, the developer preferably contains carbonate in an amount of from 0.2 mol/l to less than 0.8 mol/l, more preferably from 0.3 mol/l to less than 0.6 mol/l, so as to reduce waste water.

The thiosulfate ion for use in the fixing solution of the present invention may be used in the form of an alkali metal salt such as a lithium salt, a sodium salt or a potassium salt. In particular, it is preferably present therein in the form of sodium bisulfite or sodium sulfite.

The thiosulfate concentration in the fixing solution is preferably 0.3 mol/l or more, more preferably from 0.3 mol/l to 1.0 mol/l, most preferably from 0.4 mol/l to 0.8 mol/l.

The replenishing amount of the fixing solution is preferably from 0 to 15 ml/775 cm$^2$, most preferably from 5 to 10 ml/775 cm$^2$.

The fixing solution used in the present invention is an aqueous solution containing thiosulfate and the photographic material is preferably fixed with the fixing solution having a pH of preferably from 5.0 to 6.5, more preferably from 5.2 to 6.2. In particular, the fixing solution at a pH of 5.0 or more has no odor of sulfurous acid and is suitable in view of the working environment.

Examples of the fixing agent to be incorporated in the fixing solution include sodium thiosulfate, and ammonium thiosulfate. The amount of such a fixing agent to be used may be properly altered. The fixing solution may contain a water-soluble aluminum salt which serves as a hardener. Examples of such a water-soluble aluminum salt include aluminum chloride, aluminum sulfate, and potash alum.

The sodium thiosulfate is preferred as the fixing agent in view of an environmental problem. The amount of such a fixing agent to be used may be properly altered. Particularly, it is preferred that the fixing solution does not contain a water-soluble aluminum salt which serves as a hardener.

The fixing solution may contain tartaric acid, citric acid, gluconic acid, maleic acid or derivatives thereof, singly or in combination. Such a compound may be effectively incorporated in preferably an amount of 0.005 mol or more, particularly preferably 0.01 mol/l to 0.03 mol/l per l of the fixing solution.

If necessary, the fixing solution may contain a preservative (e.g., sulfite, bisulfite), a pH buffer (e.g., acetic acid, boric acid), a pH adjustor (e.g., sulfuric acid), a chelating agent capable of softening hard water or a compound as described in JP-A-62-78551.

In order to accelerate fixing in the processing method according to the present invention, a method as disclosed in JP-A-1-4739, and JP-A-3-101728 may be used.

In the processing method according to the present invention, the photographic material which has been developed and fixed is processed with a rinsing water or stabilizing solution, and then dried.

As the automatic developing machine which can be used in the present invention, any of various types of automatic developing machines such as roller conveyance type and belt conveyance type can be used. The roller conveyance type automatic developing machine is preferred. Further, by employing an automatic developing machine equipped with a developing tank having a small opening rate (preferably not more than 0.04 $cm^{-1}$) as described in JP-A-1-166040 and JP-A-1-193853, the processing can be effected with less air oxidation or evaporation, and the photographic material can be squeezed to fully remove the rinsing water therefrom, i.e., dried via a squeeze roller.

It may be further preferred that the rinsing water to be used in the present invention be subjected to pretreatment before being supplied into the rinsing bath, i.e., filtration through a filter member or activated charcoal filter to remove dust and organic substances therefrom.

As antifungal methods there have been well-known an ultraviolet-ray irradiation method as disclosed in JP-A-60-263939, a method using magnetic field as disclosed in JP-A-60-263940, a method which comprises use of an ion-exchange resin to produce pure water as disclosed in JP-A-61-131632, a method which comprises circulating a filter and an adsorbent column with ozone being blown as disclosed in JP-A-4-151143 and Japanese Patent Application No. 2-208638, a method utilizing microbiological degradation as disclosed in JP-A-4-240638, and a method using a microbicide as disclosed in JP-A-62-115154, JP-A-62-153952, JP-A-62-220951, and JP-A-62-209532. These methods may be used in combination with the foregoing pretreatment.

Further, microbiocides, antifungal agents and surface active agents as disclosed in M. W. Beach, "Microbiological Growths in Motion-picture Processing", SMPTE Journal Vol. 85, 1976, R. O. Deegan, "Photo Processing Wash Water Biocides", J. Imaging Tech., vol. 10, No. 6, 1984, JP-A-57-8542, JP-A-57-58143, JP-A-58-105145, JP-A-57-132146, JP-A-58-18631, JP-A-57-97530, and JP-A-57-257244 may be used as necessary.

The rinsing bath (or stabilizing bath) may further contain an isothiazoline compound as described in R. T. Kreiman, "J. Image. Tech.", vol. 10, No. 6, page 242, 1984, bromochlorodimethylhydantoin, an isothiazoline compound as described in Research Disclosure, vol. 205, No. 20526, May 1981, and vol. 228, No. 22845, April 1983, a compound as described in JP-A-62-209532, etc. as a microbicide as necessary.

In addition, compounds as disclosed in Hiroshi Horiguchi, "Bokin Bobai no Kagaku (Chemistry of Microbiocides and Antifungal Agents)", Mitsui Shuppan, 1982, and "Bokin Bobai Gijutsu Handbook (Handbook of Microbicidal and Antifungal Technology)", Nihon Bokin Bobai Gakkai, Hakuhodo, 1986 may be incorporated in the rinsing bath.

The photographic material which has been developed, fixed and rinsed (or stabilized) is then squeezed to fully remove the rinsing water therefrom, i.e., dried via a squeeze roller. The drying process is effected at a temperature of about 40° C. to about 100° C. The drying time may be properly altered depending on the surrounding conditions. In general, it may be from about 5 seconds to 3 minutes. In a particularly preferred embodiment, the drying process is effected at a temperature of 40° to 80° C. for about 5 seconds to 2 minutes.

If development is effected for not longer than 100 seconds on a dry-to-dry basis, the following treatments can be conducted to inhibit uneven development due to rapid processing. For example, a rubber roller as described in JP-A-63-151943 can be used as a roller at the exit of the developing tank. Further, the rate of agitation of the developer in the developer tank can be controlled to not less than 10 meter/min. in a delivery flow rate as described in JP-A-63-151944. Moreover, agitation can be stronger at least during development than during the waiting period as described in JP-A-63-264758.

In the processing method according to the present invention, the photographic material to be processed is not specifically limited. A commonly used black-and-white photographic material can be mainly used. In particular, the processing method according to the present invention can be applied to photographic material for laser light, printing photographic material, medical X-ray photographic material for direct picture taking, medical X-ray photographic material for indirect picture taking, photographic material for recording CRT image, microfilm, common photographic material for picture taking, etc.

The emulsion grains used in the present invention will be described hereinafter. The average diameter of spheres having the same volume as the emulsion grains (hereinafter referred to as "average grain size corresponding to grain size of sphere") is preferably in the range of from not less than 0.2 μm to less than 2.0 μm, particularly from not less than 0.5 μm to less than 1.5 μm. The grain size distribution is preferably narrow. The silver halide grains in the emulsion may have a regular crystal form such as cube, octahedron and tetradecahedron or an irregular crystal form such as sphere, tabular form and pebble-like form. The emulsion may consist of a mixture of grains having various crystal forms. Tabular grains having a grain length of 5 or more times a grain thickness may be preferably used in the present invention (as further described in Research Disclosure vol. 225, Item 22,534, pp. 20–58, January 1983, JP-A-58-127921 (The term "JP-A" as used herein means an "unexamined published Japanese patent application"), JP-A-58-113926). The preparation of tabular silver halide grains can be accomplished by effecting methods known in the art in a proper combination. An emulsion of tabular silver halide grains can be easily prepared by referring to methods as described in JP-A-58-127921, JP-A-58-113927, JP-A-58-113928, and U.S. Pat. No. 4,439,520. The diameter of projected area of tabular grains according to the present invention is preferably in the range of 0.3 to 2.0 μm, particularly 0.5 to 1.2 μm. Further, the distance between parallel planes (grain thickness) is preferably in the range of 0.05 to 0.3 μm, particularly 0.1 to 0.25 μm. The aspect ratio of tabular grains is preferably in the range of from not less than 3 to less than 20, particularly from not less than 4 to less than 8. The emulsion of tabular silver halide grains according to the present invention preferably comprises silver halide grains having an aspect ratio of not less than 2 in a proportion of not less than 50%, particularly not less than 70% of all grains as calculated in terms of projected area. The average aspect ratio of the tabular grains is preferably not less than 3, particularly from 4 to 8.

In order to make an effective utilization of the effects of the present invention, conventional selenium compounds as disclosed in prior patents may be used as selenium sensitizers. As non-unstable selenium compounds which can be used in the present invention, compounds as disclosed in JP-B-46-4553 (The term "JP-B" as used herein means an "examined Japanese patent publication"), JP-B-52-34492, and JP-B-52-34491 can be used. Examples of such the non-unstable selenium compounds include selenious acid, potassium selenocyanide, selenazoles, quaternary salts of selenazoles, diaryl selenide, diaryl diselenide, dialkyl selenide, dialkyl diselenide, 2-selenazolidine dione, 2-selenoxazolidine thion, and derivatives thereof.

Examples of silver halide solvents which can be used in the present invention include (a) organic thioethers as disclosed in U.S. Pat. Nos. 3,271,157, 3,531,289, 3,574,628, JP-A-54-1019, and JP-A-54-158917, (b) thiourea derivatives as disclosed in JP-A-53-82408, JP-A-55-77737, and JP-A-55-2982, (c) silver halide solvents having a thiocarboxyl group interposed between an oxygen atom or sulfur atom and a nitrogen atom as disclosed in JP-A-53-144319, (d) imidazoles as disclosed in JP-A-54-100717, (e) sulfites, and (f) thiocyanates. Particularly preferred among these silver halide solvents are thiocyanate and tetramethylthiourea. The amount of the solvent to be used depends on the kind thereof. If the solvent is thiocyanate, the amount thereof is preferably in the range of from not less than $1\times10^{-4}$ mol to not more than $1\times10^{-2}$ mol per mol of silver halide. The silver halide photographic emulsion according to the present invention can be subjected to sulfur sensitization and gold sensitization, singly or in combination, as chemical sensitization to attain a high sensitivity and reduce the formation of fog. Sulfur sensitization is normally effected by stirring the emulsion with a sulfur sensitizer at a high temperature, preferably not lower than 40° C. for a predetermined period of time. Gold sensitization is normally effected by stirring the emulsion with a gold sensitizer at a high temperature, preferably not lower than 40° C. for a predetermined period of time. As the sulfur sensitizer which can be used in the foregoing sulfur sensitization, well-known compounds such as thiosulfate, thiourea, allylisothiocyanate, cystine, p-toluenethiosulfonate and rhodanine can be used. In addition, sulfur sensitizers as disclosed in U.S. Pat. Nos. 1,574,944, 2,410,689, 2,278,947, 2,728,668, 3,501,313, 3,656,955, German Patent 1,422,869, JP-B-56-24937, and JP-A-55-45016 can be used. The amount of the sulfur sensitizer to be added may be such that the sensitivity of the emulsion can be effectively raised. The amount of the sulfur sensitizer to be added varies widely with various conditions such as pH, temperature and size of silver halide grains. It is in the range of preferably from not less than $1\times10^{-7}$ mol to not more than $5\times10^{-4}$ mol.

As the foregoing gold sensitizer to be used in gold sensitization a gold compound commonly used as a gold sensitizer whose oxidation number may be either +1 valence or +3 valence can be used. Examples of such the gold compound include chloroaurate, potassium chloroaurate, auric trichloride, potassium auric thiocyanate, potassium iodoaurate, tetracyanoauric acid, ammonium aurothiocyanate, and pyrydil trichloroaurate. The amount of such the gold sensitizer to be added varies with various conditions. In general, it is in the range of preferably from not less than $1\times10^{-7}$ mol to not more than $5\times10^{-4}$ mol.

In order to make effective utilization of the effects of the present invention, a silver halide-adsorbing substance is preferably allowed to present in the system during the chemical sensitization of the emulsion in the preparation of the emulsion in an amount of not less than 0.5 mmol per mol of silver halide as described in JP-A-2-68539. The addition of the silver halide-adsorbing substance may be effected at any time, e.g., during the formation of grains, immediately after the formation of grains, before or after the beginning of chemical ripening. It is preferably effected before or at the same time with the addition of a chemical sensitizer (e.g., gold or sulfur sensitizer). Such the silver halide-adsorbing substance needs to be present at least in progress of the chemical sensitization. The silver halide-adsorbing substance may be added at any temperature between 30° C. and 80° C. Preferably, it is between 50° C. and 80° C. for the purpose of enhancing the adsorbing properties of the silver halide-adsorbing substance. The addition of the silver halide-adsorbing substance may be effected at any pH and pAg values. However, chemical sensitization is preferably effected at a p11 value of 5 to 10 and a pAg value of 7 to 9.

The term "silver halide-adsorbing substance" as used herein means a sensitizing dye or photographic performance stabilizer. Examples of such the silver halide-adsorbing substance include azoles such as benzothiazolium salt, benzoimidazolium salt, imidazole, benzimidazole, nitroindazole, triazole, benzotriazole, tetrazole and triazine; mercapto compounds such as mercaptothiazole, mercaptobenzothiazole, mercaptoimidazole, mercaptobenzimidazole, mercaptobenzooxazole, mercaptothiadiazole, mercaptooxadiazole, mercaptotetrazole, mercaptopyrimidine and mercaptotriazine; thioketo compounds such as oxazolinethione; azaindenes such as triazaindene, tetraazaindene (particularly 4-hydroxy-substituted (1,3,3a,7)tetraazaindene) and pentaazaindene; and many other compounds known as fog inhibitors or stabilizers. Further as another adsorbing substance which may be used in the present invention, substances such as purines, nucleic acids, and high molecular compounds as disclosed in JP-B-61-36213, and JP-A-59-90844 may be also used.

As a silver halide-adsorbing substance, a sensitizing dye may achieve desirable effects. Examples of a sensitizing dye which can be used in the present invention include cyanine dye, melocyanine dye, complex cyanine dye, complex melocyanine dye, holopolar cyanine dye, styryl dye, hemicyanine dye, oxonol dye, and hemioxonol dye. Examples of useful sensitizing dyes which can be used in the present invention are described in U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632, and 2,503,776, JP-A-48-76525, and Belgian Patent 691,807.

The photographic emulsion layer or other hydrophilic colloidal layers of the light-sensitive material prepared according to the present invention may contain various surfactants for various purposes, e.g., as coating aids, as antistatic agents, for improvement of sliding properties, for improvement of emulsification and dispersing, for prevention of adhesion, for improvement of photographic properties (e.g., development acceleration, increase in contrast and increase in sensitivity).

As binder or protective colloid to be incorporated in the emulsion layer or interlayer and surface protective layer of the light-sensitive material of the present invention, gelatin can be advantageously used. Other hydrophilic colloids can be also used. For example, proteins such as gelatin derivative, graft polymer of gelatin and other high molecular compounds, albumin and casein; cellulose derivatives such as hydroxyethyl cellulose, carboxymethyl cellulose and cellulose sulfuric ester; saccharide derivatives such as sodium alginate, dextran and starch derivative, and various synthetic hydrophilic high molecular compounds such as single polymer and copolymer, e.g., polyvinyl alcohol, polyvinyl alcohol partial acetal, poly-N-vinyl pyrrolidone, polyacrylic acid, polymethacrylic acid, polyacrylamide, polyvinyl imidazole, and polyvinyl pyrazole. As gelatin, lime-processed gelatin as well as acid-processed gelatin and enzyme-processed gelatin may be used, and gelatin hydrolyzate and enzymatic decomposition product of gelatin may be also used. Gelatin may be preferably used in combination with dextran or polyacrylamide having an average molecular weight of not more than 50,000. Methods as disclosed in JP-A-63-68837 and JP-A-63-149641 are effective also in the present invention.

The photographic emulsion and light-insensitive hydrophilic colloid of the present invention may contain inorganic or organic film hardener. For example, chromium salts (e.g., chrome alum, chromium acetate), aldehydes (e.g., formaldehyde, glyoxal, glutaraldehyde), N-methylol compounds (e.g., dimethylolurea, methylol dimethylhydantoin), dioxane derivatives (e.g., 2,3-dihydroxydioxane), activated vinyl compounds (e.g., 1,3,5-triacryloyl-hexahydro-s-triazine, bis(vinylsulfonyl)methylether, N,N-methylenebis-[β-(vinylsulfonyl)propionamide]), activated halogen compounds (e.g., 2,4-dichloro-6-hydroxy-s-triazine), mucohalogenic acids (e.g., mucochloric acid, mucophenoxychloric acid), isooxazoles, dialdehyde starch, and 2-chloro-6-hydroxytriazinylated gelatin may be used singly or in combination. In particular, activated vinyl compounds as disclosed in JP-A-53-41221, JP-A-53-57257, JP-A-59-162546, JP-A-60-80846 and activated halides as disclosed in U.S. Pat. No. 3,325,287 are preferred.

The hydrophilic colloidal layer in the photographic material according to the present invention is preferably hardened by a film hardener such that the swelling rate thereof as determined in water is preferably not more than 280%. The swelling rate in water as defined herein is determined by freeze-drying method. In some detail, the photographic material is aged under the conditions of 25° C. and 60% RH for 7 days before the measurement for swelling rate of the hydrophilic colloidal layer. The dry thickness (a) of the photographic material is determined by measuring a section thereof under a scanning electron microscope. The swelled thickness (b) is determined by dipping the photographic material in distilled water at a temperature of 21° C. for 3 minutes, freeze-drying the material, and then observing the material with a scanning electron microscope. The swelling rate is obtained by the following formula:

$$\{(b)-(a)\}\times 100/(a)\ (\%)$$

The emulsion layer of the photographic material according to the present invention may comprise a polymer or plasticizer (e.g., emulsion) incorporated therein for the purpose of improving the pressure properties thereof. For example, British Patent 738,618 discloses use of a heterocyclic compound. British Patent 738,637 discloses use of an alkyl phthalate. British Patent 738,639 discloses use of an alkyl ester. U.S. Pat. No. 2,960,404 discloses use of a polyvalent alcohol. U.S. Pat. No. 3,121,060 discloses use of a carboxyalkyl cellulose. JP-A-49-5017 discloses use of paraffin and carboxylate. JP-A-53-28086 discloses use of an alkyl acrylate and organic acid. Other constitutions of the emulsion layer of the silver halide photographic material according to the present invention are not specifically limited. Various additives may be incorporated in the emulsion layer as necessary. For example, binders, surfactants, other dyes, coating aids, thickening agents, etc. as described in Research Disclosure vol. 176, pp. 22–28 (Dec. 1978) may be used.

A silver halide photographic material comprising a photographic emulsion layer on both sides thereof has disadvantage that image deterioration is easily generated by crossover light. The crossover light is emitted by the respective sensitizing screen positioned on the both sides of the light-sensitive material and then transmitted by the support (normally as thick as 170 to 180 μm) for the light-sensitive material to reach the photosensitive layer on the opposite side thereof. The crossover light causes a deterioration of image quality (particularly sharpness).

The less the crossover light is, the sharper is the resulting image. There are various ways of reducing the crossover light. The most preferred way is to fix a decolorable dye between the support and the photosensitive layer by development. The use of a fine crystalline dye as taught in U.S. Pat. No. 4,803,150 is very desirable because this dye can be well fixed and decolored and can be used in a large amount to reduce the crossover light. This approach causes no desensitization due to failure of fixing and enables decoloration of the dye by a 90-second processing, reducing the crossover by more than 85%.

More preferably, the dye layer for reducing the crossover light comprises a dye in a concentration as high as possible. The coated amount of gelatin used as a binder is preferably reduced such that the thickness of the dye layer is not more than 0.5 μm. However, since the extreme reduction of the layer thickness can easily cause poor contact, the preferable thickness of the dye layer is in the range of 0.05 to 0.3 μm.

The size distribution of silver halide grains may be narrow or wide. A so-called monodispersed emulsion is preferred in photographic properties such as latent image stability and pressure resistance and processing stability such as pH dependence of developer. The value S/d obtained by dividing the standard deviation S of diameter distribution of silver halide grains by the average diameter thereof as calculated in terms of circle having the same area as the projected area of silver halide grains is preferably not more than 20%, more preferably not more than 15%.

The preparation of silver chloride, silver bromochloride or silver bromochloroiodide emulsion to be used in the present invention can be accomplished by any suitable method as disclosed in P. Glafkides, "Chimie et Physique Photographique", Paul Montel, 1967, G. F. Duffin, "Photographic Emulsion Chemistry", The Focal Press, 1966, and V. L. Zelikman et al., "Making and Coating Photographic Emulsion", The Focal Press, 1964. In some detail, the emulsion can be prepared by any of the acid process, the neutral process, the ammonia process, etc. In particular, the acid process and neutral process are preferred because they can minimize the formation of fog. The reaction between a soluble silver salt and a soluble halogen salt to obtain a silver halide emulsion can be carried out by any of a so-called single jet process, a so-called double jet process, a combination thereof, and the like. A method in which grains are formed in the presence of excess silver ions may be used. Further, a so-called controlled double jet process, in which a pAg value of a liquid phase in which silver halide grains are formed is maintained constant, is more preferred.

According to the controlled double jet process, a silver halide emulsion having a regular crystal form and a narrow grain size distribution can be obtained.

In order to form high chloride content-silver grains, a method which comprises the use of a bispyridinium compound as described in JP-A-2-32, JP-A-3-137632, JP-A-4-6546, JP-A-5-53231, and JP-A-5-127279 and a method as described in JP-A-62-293536, JP-A-1-155332, JP-A-63-2043, JP-A-63-25643, U.S. Pat. Nos. 4,400,463 and 5,061,617 may be preferably used.

During the growth or physical ripening of the foregoing silver halide grains, cadmium salts, zinc salts, lead salts, thallium salts, iridium salts or complex salts thereof, rhodium salts or complex salts, iron salts or complex salts thereof, etc. may be present in the system.

During or after the grain formation, a silver halide solvent (e.g., known silver halide solvents such as ammonia, thiocyanate and thioethers and thione compounds as described in U.S. Pat. No. 3,271,157, JP-A-51-12360, JP-A-53-82408, JP-A-53-144319, JP-A-54-100717, and JP-A-54-155828) may be used. When used in combination with the foregoing method, such the silver halide solvent can provide a silver halide emulsion having a regular crystal form and a narrow grain size distribution.

The black-and-white photographic material prepared according to the present invention may contain a water-soluble dye in the hydrophilic colloidal layer as a filter dye or for the purpose of inhibiting irradiation and other various purposes. Examples of such the water-soluble dye include an oxonol dye, a hemioxonol dye, a styryl dye, a melocyanine dye, a cyanine dye, and an azo dye. Particularly useful among these dyes are an oxonol dye, a hemioxonol dye, and a melocyanine dye.

The support for the photographic material according to the present invention needs to have a thickness of 150 to 250 μm. This is essential in respect of handling property upon observation over a medical schaukasten (i.e., light table). The support is preferably a polyethylene terephthalate film. In particular, it is preferably colored blue.

The surface of the support is preferably subjected to corona discharge treatment, glow discharge treatment or ultraviolet-ray irradiation treatment to enhance the adhesivity to the hydrophilic colloidal layer. Alternatively, the support may comprise an undercoating layer made of a styrenebutadiene latex, chlorinated vinylidene latex or the like provided thereon. A gelatin layer may be further provided on the undercoating layer.

Alternatively, the support may comprise an under-coating layer made of an organic solvent containing a polyethylene swelling agent and gelatin provided thereon.

These undercoating layers may be subjected to surface treatment to further enhance the adhesivity to the hydrophilic colloidal layer.

As the various additives to be incorporated in the photographic material according to the present invention there can be used those tabulated below.

| Item | Where to find |
|---|---|
| 1) Chemical sensitization method | Line 13, upper right column - line 16, upper left column on page 10 of JP-A-2-68539; JP-A-5-313282 |
| 2) Fog inhibitor (Antifoggants), stabilizer | Line 17, lower left column, page 10 - line 7, upper left column, page 11 and line 2, lower left column - lower left column, page 3 of JP-A-2-68539 |
| 3) Color tone improver | Line 7, lower left column, page 2 - line 20, lower left column, page 10 of JP-A-62-276539; line 15, lower left column, page 6 - line 19, upper right column, page 11 of JP-A-3-94249 |
| 4) Surfactants, antistatic agent | Line 14, upper right column, page 11 - line 9, upper left column, page 12 of JP-A-2-68539 |
| 5) Matting agent, lubricant, plasticizer | Line 10, upper left column - line 10, upper right column, page 12 and line 10, lower left column - line 1, lower right column, page 14 of JP-A-2-68539 |
| 6) Hydrophilic colloid | Line 11, upper right column - line 16, lower left column, page 12 of JP-A-2-68539 |
| 7) Hardener | Line 17, lower left column, page 12 - line 6, upper right column, page 13 of JP-A-2-68539 |
| 8) Polyhydroxybenzene | Upper left column, page 11 - lower left column, page 12 of JP-A-3-39948; EP 452772A |
| 9) Spectral Sensitizing Dye | Lower right column, page 4, line 4 - lower right column, page 8 of JP-A-2-68539 |
| 10) Crossover Cut Method | Upper right column, page 4, line 20 - upper right column, page 14 of JP-A-2-264944 |
| 11) Dye, Mordant | Lower left column, page 13, line 1 - lower left column, page 14, line 9 of JP-A-2-68539; Lower left column, page 14 - Lower right column, page 16 of JP-A-3-24537 |
| 12) Layer Construction | JP-A-3-198041 |

The present invention will be further described in the following examples, but the present invention should not be construed as being limited thereto.

EXAMPLE 1

Preparation of Emulsion A of the Present Invention

In a reaction vessel, was placed 1,200 ml of an aqueous gelatin solution (containing 18 g of deionized alkali-treated bone gelatin having a methionine content of about 40 μmole/g, pH 4.3) and while maintaining the temperature thereof at 43° C., 12 ml of an "Ag-1 liquid" (containing 20 g of $AgNO_3$, 0.8 g of the gelatin, and 0.2 ml of a 1N $HNO_3$ solution in 100 ml) and 12 ml of an "X-1 liquid" (containing 6.9 g of NaCl, 0.8 g of the gelatin, and 0.3 ml of a 1N HaOH solution in 100 ml) were added to the aqueous gelatin solution by a double jet method at 24 ml/minute. Then, after mixing the mixture for 2 minutes, 19 ml of an "Ag-2 liquid" (containing 2 g of $AgNO_3$, 0.8 g of the gelatin, and 0.2 ml of a 1N $HNO_3$ solution in 100 ml) and 19 ml of an "Ag-2 liquid" (containing 1.4 g of KBr, 0.8 g of the gelatin, and 0.2 ml of a 1N NaOH solution in 100 ml) were added to the mixture by a double jet method at 31 ml/minute. Then, after stirring the mixture for 2 minutes, 36 ml of the "Ag-1 liquid" and 36 ml of the "X-1 liquid" were added to the mixture by a double jet method at 48 ml/minute. Then, 20 ml of a "NaCl-1 liquid" (containing 10 g of NaCl in 100 ml) was added to the mixture, and after adjusting pH of the mixture to 4.8, the temperature thereof was raised to 75° C. Then, after ripening the mixture for 20 minutes, the temperature was lowered to 60° C., and after adjusting the pH to 5.0, an "Ag-3 liquid" (containing 10 g of $AgNO_3$ in 100 ml) and an "X-3 liquid" (containing 3.6 g of NaCl in 100 ml) were added to the mixture by a controlled double jet method at a silver potential of 130 mV. The flow rate at the initiation of the addition of the liquids was 7 ml/minute, then the liquid were added by accelerating the flow rate at 0.1 ml/minute, and 400 ml of the "Ag-3 liquid" was added.

A precipitant was added to the resulting mixture, the temperature was lowered to 30° C., precipitates formed were collected and washed with water, and after adding thereto an aqueous gelatin solution, the pH and pCl thereof were adjusted to 6.2 and 3.0, respectively, at 38° C. A part of the silver halide emulsion thus formed was sampled and a transmission type electron microphotographic images (hereinafter, is referred to as TEM images) of the replica of the silver halide grains were observed.

The form characteristic values of the silver halide grains are as follows.

(The total projected area of (100) tabular grains having an aspect ratio of at least 2/the sum of the projected area of total silver halide grains)=$a_1$=0.91, the average aspect ratio (average diameter/average thickness) of (100) tabular grains having an aspect ratio of at least $2=a_2=3.4$, the average diameter of (100) tabular grains having an aspect ratio of at least $2=a_3=1.0$ μm, (the total projected area of twin grains/the total projected area of (100) tabular grains having an aspect ratio of at least 2)$=a_4=0$, (the sum of the total projected area of (100) tabular grains having an aspect ratio of at least 2 and an edge ratio of from 1 to 1.4/the sum of the projected area of total silver halide grains)$=a_5=0.86$, (the coefficient of variation of the diameter distribution of (100) tabular grains having an aspect ratio of at least 2 of 70% of the total projected area collected in the order of the larger grains)$=a_6=0.059$, and the average thickness$=a_7=0.29$ μm.

Thereafter, after raising the temperature of the silver halide emulsion thus formed to 60° C., sodium thiosulfate was added to the emulsion, after 2 minutes since then, chloroauric acid and potassium thiocyanate were added to the mixture, and after adding thereto 4-hydroxy-methyl-1, 3,3a,7-tetraazaindene after 65 minutes since then, the emulsion was solidified by quickly cooling to provide Emulsion A. The Emulsion A was a high-silver chloride content (100) tabular grain emulsion containing 0.76 mole % silver bromide.

2. Preparation of Emulsion Coating Solution

To the Emulsion A were added the following compounds per mole of silver halide to form each emulsion coating solution.

| | |
|---|---|
| a. Spectral Sensitizing Dye [I] (shown below) | 138 mg |
| b. Polyacrylamide (molecular weight: 40,000) | 8.54 g |
| c. Trimethylolpropane | 1.2 g |
| d. Sodium polystyrenesulfonate (average molecular weight: 600,000) | 0.46 g |
| e. Latex of poly(ethyl acrylate/methacrylic acid) | 32.8 g |
| f. 1,2-Bis(vinylsulfonylacetamide)ethane | 2 g |

-continued

Spectra Sensitizing Dye [I]

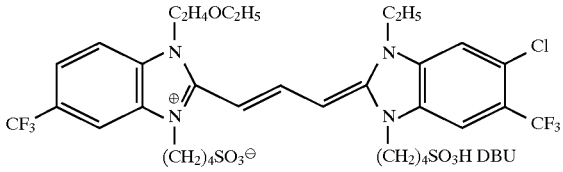

DBU:

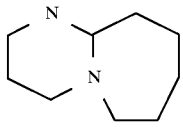

3. Preparation of Surface Protective Layer Coating Solution for Emulsion Layer

The following compounds were added to a vessel heated to 40° C. to provide the coating solution.

| | |
|---|---|
| a. Gelatin | 100 g |
| b. Polyacrylamide (molecular weight: 40,000) | 12.3 g |
| c. Sodium polystyrenesulfonate (average molecular weight: 600,000) | 0.6 g |
| d. Polymethyl methacrylate fine particles (average particle size: 2.5 μm) | 2.7 g |
| e. Sodium polyacrylate | 3.7 g |
| f. Sodium t-octylphenoxyethoxyethansulfonate | 1.5 g |
| g. $C_{16}H_{33}O-(CH_2CH_2O)_{10}-H$ | 3.3 g |
| h. $C_8H_{17}SO_3K$ | 84 mg |
| i. $C_8F_{17}SO_2N(C_3H_7)(CH_2CH_2O)_4(CH_2)_4-SO_3Na$ | 84 mg |
| j. NaOH | 0.2 g |
| k. Methanol | 78 ml |
| l. 1,2-Bis(vinylsulfonylacetamide)ethane | The amount was adjusted such that the swelled amount became the value of 8 μm |
| m. Compound [II] | 52 mg |

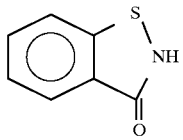

4. Preparation of Back Layer Coating Solution

The following compounds were added to a vessel heated to 40° C. to form the back layer coating solution.

| | |
|---|---|
| a. Gelatin | 100 g |
| b. Dye [I] | 2.39 g |

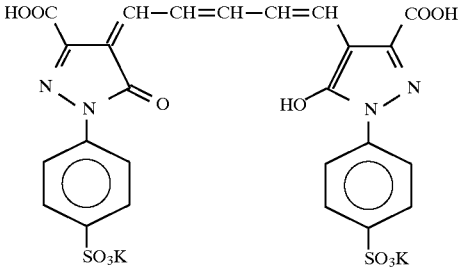

-continued

| | |
|---|---|
| c. Sodium polystyrenesulfonate | 1.1 g |
| d. Phosphoric acid | 0.55 g |
| e. Poly(ethyl acrylate/methacrylic acid) latex | 2.9 g |
| f. Compound [II] (shown above) | 46 mg |
| g. Oil dispersion described in JP-A-61-285445 of Dye [II] shown below (as dye itself) | 246 mg |

Dye [II]

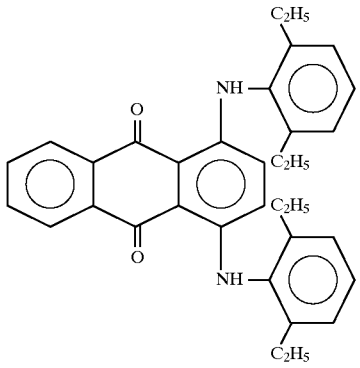

| | |
|---|---|
| h. Oil dispersion described in JP-A-61-285445 of Dye [III] (as dye itself) | 46 mg |

Dye [III]

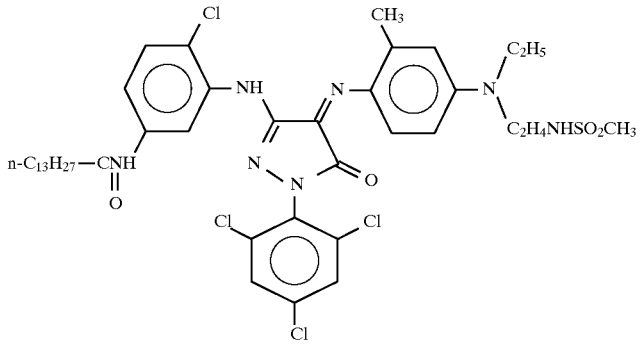

5. Preparation of Surface Protective Layer Coating Solution for Back Layer

The following compounds were added to a vessel heated to 40° C. to form the coating solution.

| | |
|---|---|
| a. Gelatin | 100 g |
| b. Sodium polystyrenesulfonate | 0.3 g |
| c. Polymethyl methacrylate fine particles (average particle size: 3.5 $\mu$m) | 4.3 g |
| d. Sodium t-Octylphenoxyethoxyethanesulfonate | 1.8 g |
| e. Sodium polyacrylate | 1.7 g |
| f. $C_{16}H_{33}O—(CH_2CH_2O)_{10}—H$ | 3.6 g |
| g. $C_8H_{17}SO_3K$ | 268 mg |
| h. $C_8F_{17}SO_2N(C_3H_7)(CH_2CH_2O)_4(CH_2)_4—SO_3Na$ | 45 mg |
| i. NaOH | 0.3 g |
| j. Methanol | 131 mg |
| k. 1,2-Bis(vinylsulfonylacetamide)ethane | The amount was adjusted to be 2.2% by weight of the total gelatin amount of the back layer and the surface protective layer thereof. |
| l. Compound [II] (shown above) | 45 mg |

6. Preparation of Coated Samples

The back layer coating solution and the surface protective layer coating solution described above were coated on one side of a polyethylene terephthalate support colored into a blue color such that the gelatin coated amount of the back layer became 2.69 g/m$^2$ and the gelatin coated amount of the surface protective layer became 1.3 g/m$^2$.

Subsequently, the above-described emulsion coating solution for the emulsion layer and surface protective coating solution were coated on the opposite side of the support so that the emulsion layer had an Ag coverage of 2.4 g/m$^2$ and a gelatin coverage of 1.8 g/m$^2$; the surface protective layer had a gelatin coverage of 1.2 g/m$^2$, the emulsion surface had a dry thickness of 3.4 $\mu$m and the emulsion surface side had a swelling amount of 8 $\mu$m.

7. Preparation of Developer

| Developer A | |
|---|---|
| Potassium sulfite | 30.0 g |
| Potassium carbonate | 55.2 g |
| Diethylene glycol | 10.0 g |
| Diethylenetriaminepentaacetic acid | 2.0 g |
| Sodium bromide | 3.0 g |
| 5-Methylbenztriazole | 0.1 g |
| 4-Hydroxymethyl-4-methyl-1-phenyl-3-pyrazolidone | 2.0 g |
| L-Ascorbic acid | 43.2 g |
| Surfactant [I] | 0.1 g |

-continued

| | |
|---|---|
| pH adjusted with sodium hydroxide | 9.5 |
| Water | 300 ml to make 1 l |

Surfactant [I]

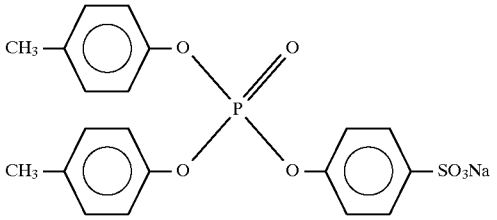

Developer B

The same as Developer A except for the addition of 0.40 g of Compound 8-5

Developer C

The same as Developer A except for the replacement of L-ascorbic acid by 27.0 g of hydroquinone Developer D The same as Developer C except for the addition of 0.40 g of Compound 8-5

The fixing solution used was SR-F1 (produced by Fuji Photo Film Co., Ltd.).

The development was conducted in CEPROS-M (manufactured by Fuji Photo Film Co., Ltd.) at the development and fixing temperature both of 35° C. with a dry-to-dry time of 47 seconds.

A running processing was conducted on 10 $m^2$ of the photographic material per day while replenishing each developer in an amount of 200 ml per $m^2$ of the film sample for 2 weeks. The results obtained are shown in Table 1.

The sensitivity was expressed by a relative value to the reciprocal of the exposure amount necessary for giving a black density of 1.0 with Developer A, while taking the exposure amount as 100. The silver stain was evaluated by 5 grade evaluations, where the state completely free of silver stain on the developing tank wall was evaluated as "5" and the state when black silver stains were generated on the entire developing tank and the developing tank was in need of cleaning was evaluated as "1".

TABLE 1

| | After 2-Week Running | |
|---|---|---|
| | Sensitivity | Silver Stain |
| Developer A Comparison | 100 | 2 |
| Developer B Invention | 100 | 5 |
| Developer C Comparison | 100 | 2 |
| Developer D Comparison | 100 | 3 |

As is apparent from the results of Table 1, with Developer B comprising Compound 8-5 and an L-ascorbic acid as a developing agent, no silver stain was generated on the developing tank wall and good results were obtained.

EXAMPLE 2

10 l of Developer B or Developer D in Example 1 was accommodated into a foldable and flexible 10 l-container of cubic type formed of Packing Material Y for developer which was composed of 2 layers consisting of nylon layer in a thickness of 75 $\mu$m and polyethylene layer in a thickness of 175 $\mu$m and had an oxygen permeability of 20 ml/$m^2$.atm.day (at 20° C., 65% RH). Separately, 10 P of Developer B or Developer D was accommodated into a foldable and flexible 10 l-container of cubic type formed of Packing Material Z for developer which made of a polyethylene vinyl acetate copolymer in a thickness of 250 $\mu$m and had an oxygen permeability of 100 ml/$m^2$.atm.day (at 20° C., 65% RH). These developers each was stored at 50° C. for 8 weeks and then the residual amount of Compound 8-5 therein was determined. The results obtained are shown in Table 2.

TABLE 2

| | Residual Amount of Compound 8–5 after Storage at 50° C. for 8 Weeks (%) |
|---|---|
| Packing Material Y Developer B | 98 |
| Packing Material Y Developer D | 80 |
| Packing Material Z Developer B | 70 |
| Packing Material Z Developer D | 0 |

As is apparent from the results in Table 2, with use of Packing Material Y having a small oxygen permeability, the residual amount of Compound 8-5 after the storage of the developer was high, in particular, Developer B comprising an L-ascorbic acid as a developing agent showed a high residual amount as 98%, which suggests that when a one-part liquid developer comprising an L-ascorbic acid as a developing agent is stored in a packing material having a low oxygen permeability, Compound 8-5 can be present stably for a long period of time and a superior effect can be achieved with respect to the prevention of silver stain upon the use.

EXAMPLE 3

A photographic material was prepared in the same manner as in Example 1. The thus-obtained photographic material was subjected to the following running processing using processing solutions as shown below in an automatic processor.

Running Processing in Automatic Processor and Developer

The processing was conducted in an automatic processor ("FPM-800A" manufactured by Fuji Photo Film Co., Ltd.) within a processing time of 210 seconds.

The running conditions were such that 40 sheets of photographic material in a 10×12 inch. size (775 $cm^2$) were processed per day and the running was continued for 4 weeks at an uptime of 5 days per week. The development temperature and the fixing temperature were commonly 35° C. and the uptime was 8 hours a day.

The exposure amount on the photographic material was set so as to give a black ratio (i.e., an exposed area ratio) of 40%.

The developer had the following composition. At the use, the composition was replenished without any dilution. The replenishing amount was 100 ml per 20 sheets each in a 10×12 inch. size (775 $cm^2$).

| Developer (1 l-Formulation) | |
|---|---|
| Diethylenetriaminepentaacetic acid | 4 g |
| $K_2CO_3$ | (described in Table 3 in terms of carbonic acid ion concentration) |
| Sodium sulfite | 30 g |
| Hydroquinone (HQ in Table 3) | 0.3 mol |

-continued

| Developer (1 l-Formulation) | |
|---|---|
| or L-ascorbic acid (L-AA in Table 3) | |
| KBr | 0.5 g |
| 5-Methylbenztriazole | 60 mg |
| 4-Methyl-4-hydroxymethyl-1-phenyl-3-pyrazolidone | 4 g |
| 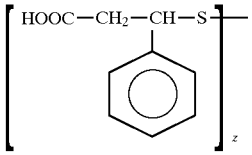 | 0.5 g |
| 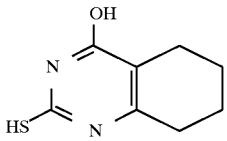 | 0.05 g |

The pH of the developer was adjusted to 9.50 by adding an acetic acid and sodium hydroxide.

The fixing solution had the following composition. At the use, the composition was replenished without any dilution. The replenishing amount was as described in Table 3. The replenishment was conducted once per 20 sheets each in a 10×12 inch. size (775 $cm^2$).

| Fixing Solution (1 l-Formulation) | |
|---|---|
| Ethylenediaminetetraacetic acid | 25 mg |
| Sodium thiosulfate | 290 g |
| Sodium bisulfite | (described in Table 3 in terms of sulfurous acid ion concentration) |
| NaOH | 2.4 g |

The pH and the replenishing amount of the fixing solution were as described in Table 3.

TABLE 3

| | Developer | | | Fixing Solution | |
|---|---|---|---|---|---|
| Processing Example | Developing Agent | Carbonate Ion concentration (mol/l) | Initial pH | Replenishing Amount (per sheet in 10 × 12 inch. size) (ml) | Thiosulfate Ion Concentration (mol/l) |
| 1 | HQ | 0.3 | 4.8 | 25 | 0.20 |
| 2 | HQ | 0.3 | 4.8 | 15 | 0.20 |
| 3 | HQ | 0.3 | 4.8 | 10 | 0.20 |
| 4 | HQ | 0.3 | 4.8 | 25 | 0.35 |
| 5 | HQ | 0.3 | 4.8 | 15 | 0.35 |
| 6 | HQ | 0.3 | 4.8 | 10 | 0.35 |
| 7 | HQ | 0.3 | 5.2 | 5 | 0.50 |
| 8 | L-AA | 0.3 | 5.2 | 5 | 0.50 |
| 9 | L-AA | 0.2 | 5.2 | 5 | 0.50 |
| 10 | L-AA | 0.1 | 5.2 | 5 | 0.50 |

Evaluation of Silver Stain

The silver stain was evaluated as follows:

G: completely no stain

M: some stains but no precipitation of silver

B: silver was precipitated

The evaluations of G and M lie on the level allowable in processing system.

Evaluation of Photographic Performance

An exposure was conducted on both sides of the photographic material for 0.05 second using X-Ray Orthoscreen ("HG-M", manufactured by Fuji Photo Film Co., Ltd.) and then the sensitivity was evaluated. The photographic material for the evaluation of sensitivity was processed twice with each processing solution, before and after the running, and the sensitivity was expressed by the reciprocal of the ratio of exposure amount giving a density of 1.0 while taking the sensitivity obtained at the processing before the running in Processing Example 1 as 100.

The evaluation results on the fixed silver stain and the photographic performance are shown in Table 4 below.

TABLE 4

| Processing Example | Relative Sensitivity before Running | Relative Sensitivity after Running | Degree of Silver Stain due to Reduced Silver |
|---|---|---|---|
| 1 (Comparison) | 100 | 80 | G |
| 2 (Comparison) | 102 | 82 | B |
| 3 (Comparison) | 98 | 80 | B |
| 4 (Comparison) | 100 | 78 | G |
| 5 (Comparison) | 102 | 80 | M |
| 6 (Comparison) | 100 | 82 | M |
| 7 (Comparison) | 101 | 80 | M |
| 8 (Invention) | 110 | 105 | G |
| 9 (Invention) | 100 | 90 | G |
| 10 (Invention) | 95 | 80 | G |

As is seen from Processing Examples 1 to 3 (comparative examples), with the use of hydroquinone as a developing agent of the developer and in a low replenishing system for the fixing solution such as the replenishing amount being 15 ml or less per sheet in a 10×12 inch. size (775 $cm^2$), the processed photographic material after the running had reduced sensitivity and the silver stain was generated due to mixing of the developer carried over with the photographic material into the fixing tank.

In Processing Examples 4 to 6 (comparative examples), the sulfurous acid ion concentration in the fixing solution was 0.35 mol/l and accordingly, the silver stain kept the allowable level in a low replenishing system with the replenishing amount for the fixing solution being 15 ml or less, however, due to the use of hydroquinone as a developing agent in the developer, the processed photographic material after the running had reduced sensitivity.

On the other hand, as seen in Processing Example 7 (comparative example), when the replenishing amount for the fixing solution was reduced to 5 ml per sheet in a 10×12 inch. size (775 $cm^2$), with the use of hydroquinone as a developing agent of the developer, the processed photographic material after the running had reduced sensitivity. However, as seen in Processing Example 8 (present invention), with the use of an L-ascorbic acid as a developing agent of the developer, the processed photographic material after the running underwent almost no reduction in the sensitivity and the silver stain of the fixing tank was extremely improved.

Further, as seen from the comparison among Processing Examples 8, 9 and 10 (examples of the present invention), with the use of an L-ascorbic acid as a developing agent of the developer and with a reduced carbonate concentration in the developer, even when the replenishing amount for the fixing solution was reduced to 5 ml per sheet in a 10×12 inch. size, satisfactory photographic properties and excellent improvement with respect to the silver stain could be achieved though superiority of the photographic performance may be lost.

Furthermore, in Processing Example 7 (comparative example) and Processing Examples 8 to 10 (examples of the present invention), the initial pH was 5.2 and the fixing solution was almost free of odor of sulfurous acid. After the running, the fixing solutions in Processing Examples 5 to 7 (comparative examples) and Processing Examples 8 to 10 examples of the present invention) each had a pH within the range of from 5.5 to 6.5.

While the invention has been described in detail and the reference to specific embodiments thereof, it will be apparent to one skilled in the art that various changes and modifications can be made therein without departing from the spirit and scope thereof.

What is claimed is:

1. A one-part liquid developer for a black-and-white silver halide photographic material comprising the following composition:

(a) an ascorbic acid or a derivative thereof as a developing agent present in an amount of from 5 to 80 g per l of the developer, provided that the developing agent is not hydroquinone;

(b) an auxiliary developing agent having super-additivity present in an amount of from $5\times10^{-4}$ to $5\times10^{-2}$ mol per l of the developer;

(c) an alkali agent necessary at least for giving a pH of 9.0; and (d) a compound represented by formula (I) or (II) present in a concentration of from 0.1 to 5 mol/l of the developer:

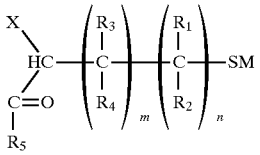

(I)

-continued

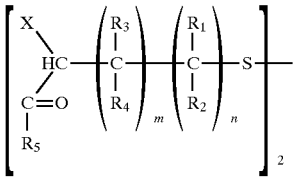

(II)

wherein $R_1$ and $R_2$ each represents a hydrogen atom, an alkyl group having from 1 to 3 carbon atoms or a phenyl group, $R_3$ and $R_4$ each represents a hydrogen atom or an alkyl group having from 1 to 3 carbon atoms, m and n each represents 0, 1 or 2, $R_5$ represents a hydroxyl group, an amino group or an alkyl group having from 1 to 3 carbon atoms, M represents a hydrogen atom, an alkali metal atom or an ammonium group, X represents a hydrogen atom, a alkyl group having from 1 to 3 carbon atoms, a sulfonyl group, an amino group, an acylamino group, a dimethylamino group, an alkylsulfonylamino group or an arylsulfonylamino group, wherein said developer is accommodated in a packing material comprising at least one of a saponified product of an ethylene-vinyl acetate copolymer and a nylon, said packing material having an oxygen permeability of 50 $ml/m^2$.atm.day or less (at a temperature of 20° and a relative humidity of 65%).

2. A developer according to claim 1, wherein the packing material is a plastic packing material having an oxygen permeability of 25 $ml/m^2$ atom day or less (at 25° C., 65% RH).

* * * * *

UNITED STATES PATENT AND TRADEMARK OFFICE

CERTIFICATE OF CORRECTION

PATENT NO. : 5,824,458
DATED : October 20, 1998
INVENTOR(S) : Eiichi OKUTSU, Rikio INOUE It is certified that error appears in the above-identified patent and that said Letters Patent is hereby corrected as shown below:

Column 25, line 29, change "5 mol/l" to --5 mmol/l--.

Signed and Sealed this

Fourteenth Day of December, 1999

*Attest:*

Q. TODD DICKINSON

*Attesting Officer*

*Acting Commissioner of Patents and Trademarks*